United States Patent [19]

Minneman

[11] Patent Number: 5,058,302

[45] Date of Patent: Oct. 22, 1991

[54] SHOOTER'S PORTABLE MAINTENANCE CENTER

[75] Inventor: William J. Minneman, c/o MTM Molded Products Company, 5680 Webster St., Dayton, Ohio 45414

[73] Assignee: William J. Minneman, Clayton, Ohio

[21] Appl. No.: 557,277

[22] Filed: Jul. 24, 1990

[51] Int. Cl.[5] ..... F41A 23/18; B65D 85/00

[52] U.S. Cl. ..... 42/94; 89/37.04; 206/315.11

[58] Field of Search ..... 42/94; 89/37.04; 206/315.11

[56] References Cited

U.S. PATENT DOCUMENTS

| | | | |
|---|---|---|---|
| 2,121,982 | 6/1938 | Pugsley | 89/37.04 |
| 2,774,563 | 12/1956 | Pribis | 89/37.04 |
| 2,877,689 | 3/1959 | Pribis | 89/37.04 |
| 3,913,746 | 10/1975 | Burton | 211/64 |
| 3,964,613 | 6/1976 | Anderson, Jr. | 211/64 |
| 4,341,304 | 7/1982 | Diller | 206/349 |
| 4,342,403 | 8/1982 | Badtke et al. | 220/345 |
| 4,460,085 | 7/1984 | Jantzen | 206/349 |
| 4,548,392 | 10/1985 | Rickling | 89/37.04 |
| 4,815,593 | 3/1989 | Brown | 206/315 |
| 4,873,777 | 10/1989 | Southard | 42/94 |

OTHER PUBLICATIONS

MTM Quality in Thermoplastics CASE-GARD 1990 Catalog.

MTM Molded Products Rep. List (Exhibit A).

*Primary Examiner*—Charles T. Jordan

*Attorney, Agent, or Firm*—Biebel & French

[57] ABSTRACT

A portable rifle maintenance center is disclosed which includes a rectangular tray having gun support forks attachable to the rectangular tray for temporarily storing the rifle in a horizontal position. The rectangular tray has slidable covers attached adjacent to an open upper face of the rectangular tray which slide to access storage compartments within the rectangular tray. The gun support forks are removable from the rectangular tray and profiled to be stored within one of the compartments. The bottom face of the rectangular tray is profiled for temporarily resting upon a cover member of an enclosed accessory case. The rectangular tray includes a central opening therethrough, which provides access to a carrying handle of the accessory case, such that both the tray and the accessory case can be carried as a single unit.

20 Claims, 3 Drawing Sheets

SHOOTER'S PORTABLE MAINTENANCE CENTER

BACKGROUND OF THE INVENTION

The present invention relates to a portable work station and support apparatus for a long barrelled rifle.

DESCRIPTION OF THE PRIOR ART

U.S. Pat. No. 3,964,613 discloses a rifle support having vertical uprights for positioning the rifle, and further including an integral storage compartment for such items used with the rifle. Although U.S. Pat. No. 3,964,613 indicates that the support can be used in the home, in the field or at the rifle range, and includes a nylon cord as a carrying sling for that purpose, the above support appears to be quite cumbersome and awkward for such use. It should be noted that the storage area is not conveniently separated into individual compartments and the support is constructed of wood pieces which would add to the weight of the support and burden the user when carrying such support, particularly if the user was to carry the apparatus into the rifle range or into the field is proposed.

U.S. Pat. No. 4,815,593 shows a similar structure having vertical supports for retaining a long barrelled rifle in a horizontal position and further includes a storage compartment as shown in either of FIGS. 1 or 2 of the disclosure. The gun support shown in U.S. Pat. No. 4,815,593 is similarly cumbersome having only slots at the end walls of the support for carrying purposes. This apparatus too, would not appear to be suitable for carrying the case onto the rifle range or into the field.

SUMMARY OF THE INVENTION

An object of the instant invention then is to provide for a rifle support and maintenance assembly which is convenient for the user to carry; a further object of the invention is to provide for a gun support where the support is somewhat modular in nature which will prevent the gun support from being cumbersome and awkward; a further object of the invention is to provide for a gun support and maintenance assembly where the gun support can also be used as a shooting rest for the user; and another object of the invention is to provide for a gun support and maintenance assembly having a plurality of compartments for the organization of the items to be carried and used with the rifle.

These and other objects of the invention are accomplished by designing a long barrelled gun holder having a rectangular box including a bottom, two opposed long sides and two opposed short sides. A pair of gun support forks include base portions and top portions where the top portions have open top slots for receiving a section of a gun barrel and where the base portions are insertable into the box. The box includes wall members located adjacent to the short sides and dimensioned to receive the base portions of the forks. The remainder of the box provides storage for gun maintenance accessories.

In a second embodiment of the invention, a portable rifle maintenance assembly comprises an accessory box and a gun support assembly, where the accessory box comprises a lower section and an upper section hinged to the lower section, the lower section including accessory storage compartments and the upper section including a carrying handle mounted thereto for the manual transport of the accessory box. The assembly further comprises a gun support assembly which is receivable over the accessory box where the gun support assembly includes a rectangular tray having a bottom section, long side sections, and short side sections, thereby defining an open upper face of the tray. The bottom section has a wall extending downwardly from each of the long side sections thereby cooperating with the bottom section to define a receiving nest for the upper section of the accessory box. The rectangular tray includes a central opening therethrough for the passage of a carrying handle of the accessory box. Gun support forks are attached to the rectangular tray and have open top slots for the receipt of a section of a rifle barrel.

Other objects and advantages of the invention will be apparent from the following description, the accompanying drawings and the appended claims.

DETAILED DESCRIPTION OF THE PREFERRED EMBODIMENT

Figure 1:
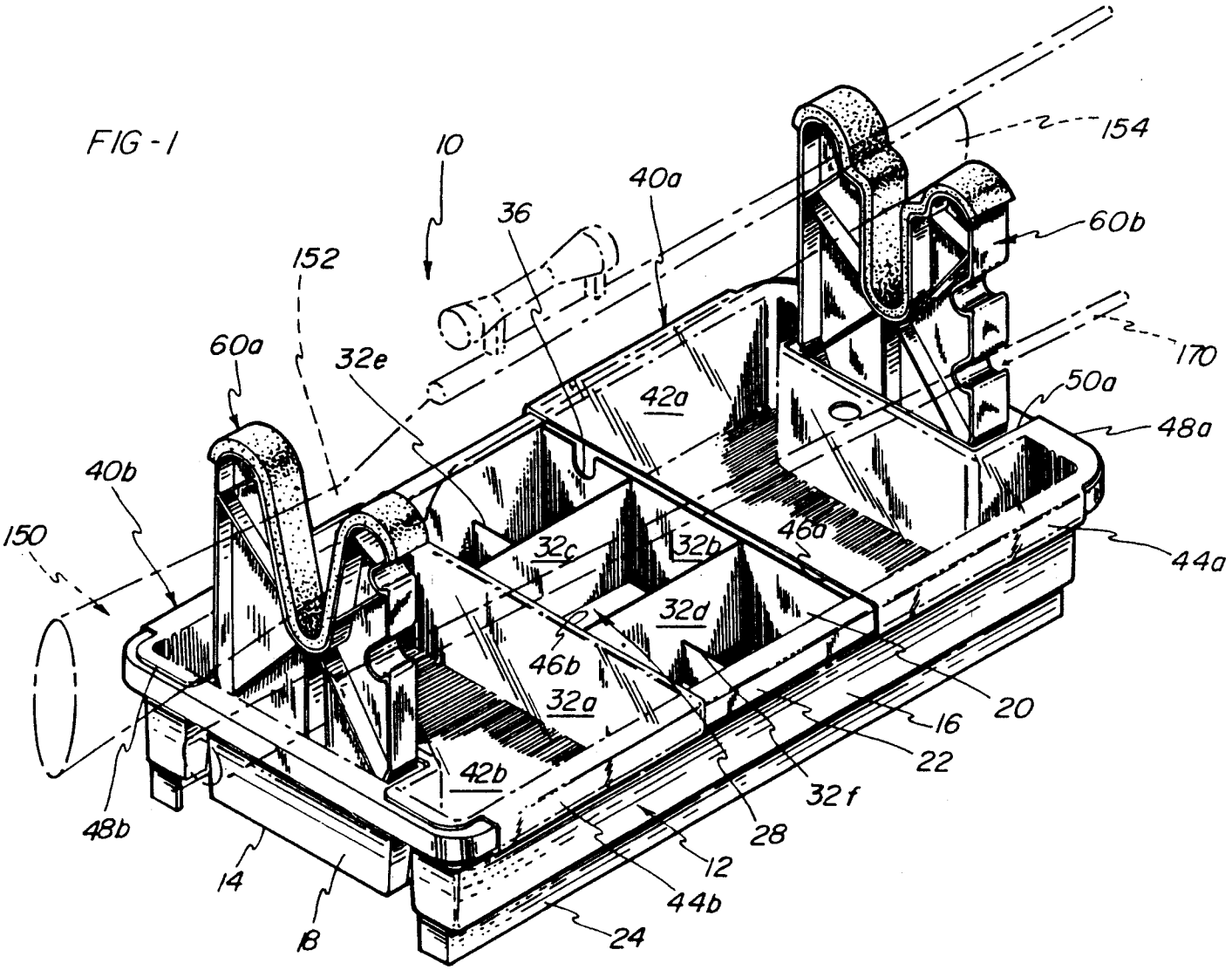
FIG. 1 is a perspective view of the rifle maintenance assembly in accordance with the invention, showing in phantom, a rifle perched between the two gun support forks.

With reference first to FIG. 1, the rifle maintenance assembly is generally designated by reference numeral 10 and generally includes a rectangular tray 12, identical slidable top covers 40*a* and 40*b*, and removable gun support members 60*a* and 60*b*.

With reference still to FIG. 1, the rectangular tray 12 includes a bottom wall 14, long side sections 16 and short side sections 18. The wall portions 14, 16 and 18 cooperate to define an open upper face 20 of the tray 12. Wall portions 24 extend downwardly from the long side sections 16 and below the bottom wall 14 of the tray thereby defining a nest section. At the top of the long and short side walls 16, 18 respectively, is a peripheral rim 22 which extends circumferentially around the tray 12 and is preferably integral therewith.

Figure 2:
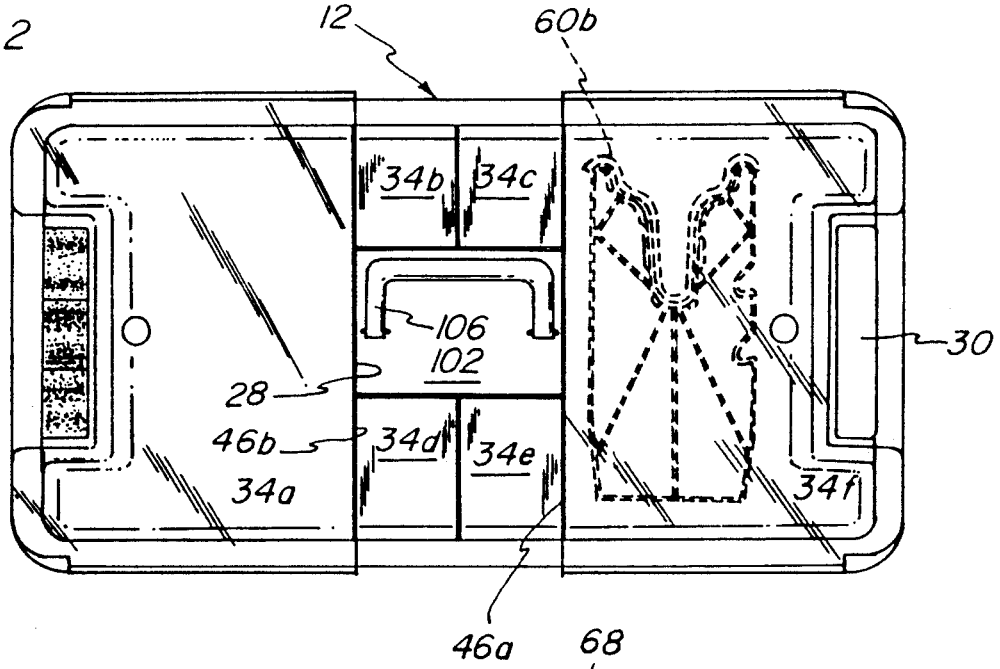
FIG. 2 is an upper plan view of the assembly shown in FIG. 1, showing the assembly placed on the top of an accessory carrying case.

As shown in FIG. 2, the tray 12 includes two end slots or sockets 30 adjacent to the short side walls 18, the end slots being profiled for the receipt of the gun support members 60*a* and 60*b*, as described more fully herein. With reference to FIGS. 1 and 2, the tray 12 also includes dividing wall sections 32*a* and 32*b* which are parallel to the short side walls 18, and extend between the two long sidewalls 16. The wall section 32*a* and one of the short side walls 18 thereby define an inner compartment 34*a*, (as viewed in FIG. 2), and wall section 32*b* and the opposite short side wall section 18 define an inner compartment 34*f*, (as viewed in FIG. 2).

Two further wall sections 32*c* and 32*d* (FIG. 1) extend between the wall sections 32*a* and 32*b*, and together with wall sections 32*e* and 32*f*, subdivide the remainder of the tray into compartments 34*b*–34*e*, as best seen in FIG. 2. It should also be noticed that the wall sections 32*a*–32*d*, cooperate to form a passage 28 which extends completely through the central portion of the tray.

With respect to FIG. 1 again, the assembly 10 comprises two identical covers 40*a* and 40*b*. The covers 40*a* and 40*b* include upper cover plate portions 42*a* and 42*b* having gripping side rails 44*a* and 44*b* extending downwardly from their respectively plate portions, the side rails 44*a* and 44*b* being profiled to grip the tim 22 of the rectangular tray 12, yet allow the covers 40*a* and 40*b* to be slidable relative to the tray 12. The covers 40*a* and 40*b* further include inner edges 46*a* and 46*b* and outer edges 48*a* and 48*b*, where the outer edges 48*a* and 48*b*, each include a notch section 50*a* and 50*b*.

Figure 3:
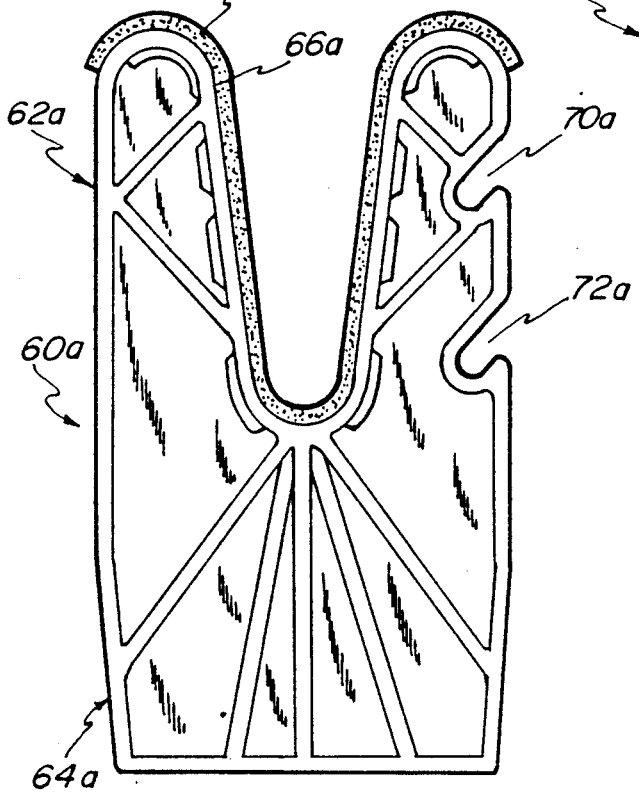
FIGS. 3 and 4 are side plan views of the gun support forks.
Figure 4:
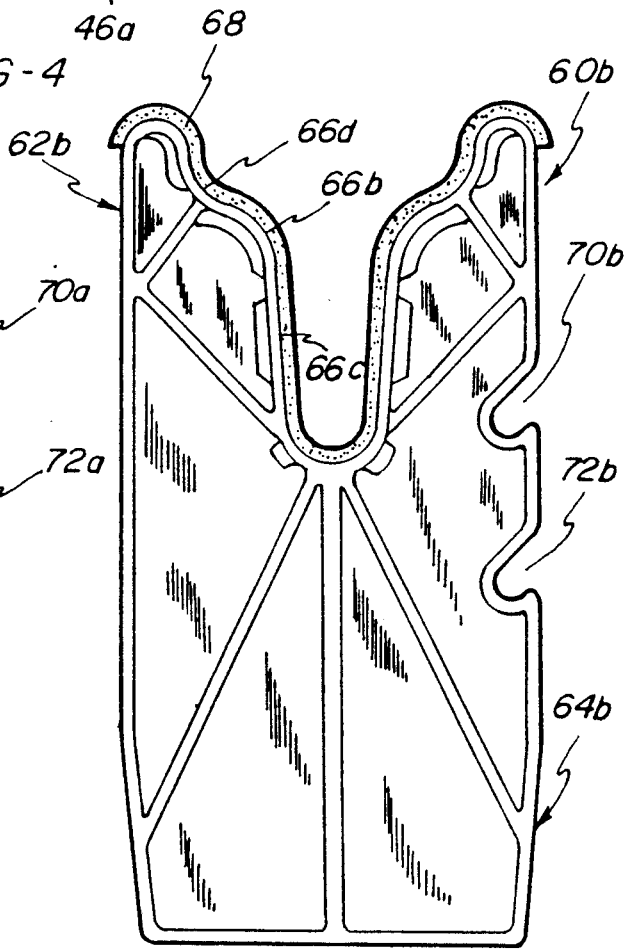

As shown in FIGS. 3 and 4, the first and second gun support forks 60*a* and 60*b* include upper gun rest sections 62*a* and 62*b*, and lower base sections 64*a* and 64*b*, respectively. The gun rest section 62*a* is defined by an elongate slot 66*a* profiled to receive a rifle stock. The gun rest section 62*b* (FIG. 4) includes a slot 66*b* having a lower narrow portion 66*c* and an upper wide section 66*d*, the gun rest section 62*b* being so profiled to support a variety of rifle configurations. The gun rest sections 62*a* and 62*b* each include padding 68 along the major portion of their slots 66*a* and 66*b*, such padding could be in the form of either felt or foam padding having double backed adhesive applied thereto, or encapsulating injected rubber and vinyl padding.

As mentioned above, the slots 30 of the rectangular tray 12 are profiled to receive the base portions 64*a* and 64*b*. The base portions 64*a* and 64*b* are profiled with a slight angle, approximately 5°, which locks the first and second gun rest portions 60*a* and 60*b* into the rectangular tray 12, and also allows the gun rest portion to be easily removed for disassembly and storage. It should also be noted that the gun rest portions 60*a* and 60*b* are retractable from the respective slots or sockets 30 and are profiled for receipt within either of the compartments 34*a* or 34*f* for storage, as shown in FIG. 2, where the gun rest 60*b* is shown in phantom in compartment 34*f*. It should also be noted that both gun rest members 60*a* and 60*b* are receivable in the same compartment, while still allowing the cover 40*a* or 40*b* to be closed over the respective compartment.

The gun supports 60*a* and 60*b* further include upper slots 70*a* and 70*b*, and lower slots 72*a* and 72*b*; the slots 70*a* and 70*b*, and 72*a* and 72*b*, cooperating to form holding sections for barrel cleaning rods, shown for example as 170 in phantom in FIG. 1, thereby preventing the cleaning rods from being contaminated with dirt or other debris.

Figure 5:
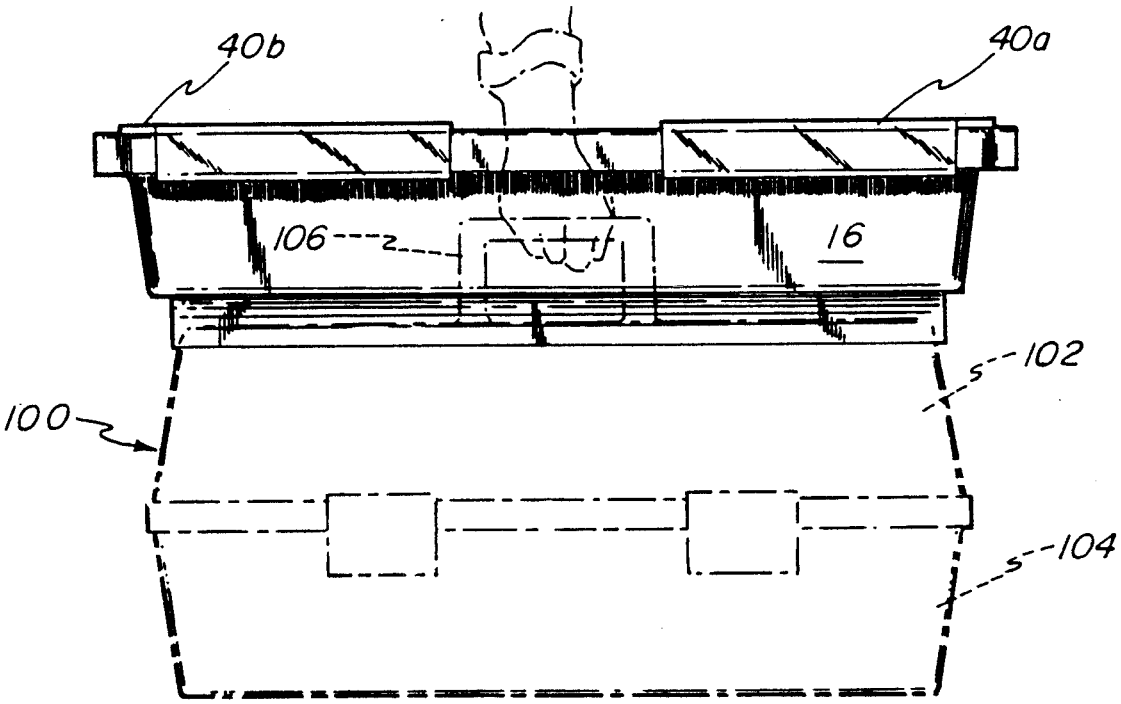
FIG. 5 is a side plan view of the assembly showing in phantom, the accessory carrying case.
Figure 6:
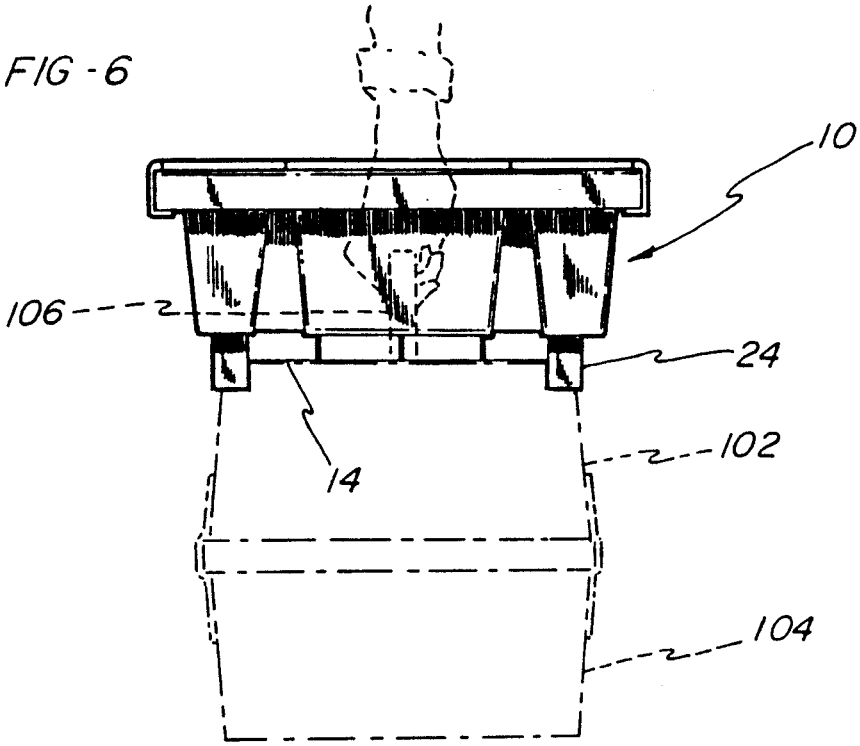
FIG. 6 is an end view of the assembly showing in phantom, the accessory carrying case.

The rifle maintenance assembly 10 is profiled for use with known types of accessory boxes. By way of example, a typical accessory box is shown generally at 100 in FIGS. 5 and 6, where the box includes an upper section 102 which is hingedly mounted to a lower section 104 and where the upper section 102 includes a carrying handle 106. It should be noted that the accessory box 100 may be similar in nature to a fishing tackle box having storage compartments and internal trays located within the box.

To carry the rifle maintenance assembly 10, the rectangular tray is inserted over the accessory box 100 such that the central opening 28 overlies the accessory box handle 106 of the accessory box 100, as shown in FIG. 2. It should be noted from FIG. 2, that the opening 28 is slightly off center, being offset somewhat towards the top of the page, as viewed in FIG. 2. The reason for such, is that in most cases, when an accessory box such as 100 is placed in a resting position, and the handle released, the handle will rotate to a position where it lays flat against the upper surface of the accessory box. Thus, with the off center opening 28, the tray section 12 can be placed over the top of the box 100, without having to first stand the handle 106 up. The user can then simply place his hand into the opening 28, grasp the handle 106 and carry both the rifle maintenance assembly 10 and the accessory box 10 together as a single unit.

The apparatus 10 is prepared for use by inserting the gun supports 60*a* and 60*b* into one of the compartments 34*a* or 34*f*, the remaining compartments being used for such articles as shells, cleaning fluids, cleaning rags, and the like. It should also be noted that the walls 32*a* and 32*b* include slots 36 which can be used for retaining an extra rifle sight or any elongate tools.

When the user arrives at the rifle range or at a suitable location within the field, the unit 10 can be assembled by sliding the cover 40*a* to the left (as viewed in FIG. 1) to expose the compartment which holds the gun support members 60*a* and 60*b*. The gun support members 60*a* and 60*b* are then removed from the carrying compartment and inserted into the slots 30 within the rectangular tray 12. The gun support members can then accept the rifle 150 such that the stock 152 of the rifle is inserted into the slot 66*a* while the opposite end of the rifle 154 rests within the slot 66*b*, as shown in phantom in FIG. 1. In this manner, the rifle can be fully assembled, and the rifle is also suitably secure for maintenance and cleaning.

The gun support members 60*a* and 60*b* should be inserted into the slots 30 such that the open slots 70*a*, 72*a*; and 70*b*, 72*b* are on the same side in order that the barrel cleaning rods 170 can be temporarily held in place in the slots. It should be noted that the cover 40*b* can also be slid to the right (as viewed in FIG. 1) to access items within the compartment 34*a*.

The rifle maintenance assembly 10 can also be used as a rifle rest by removing the rifle support 60*a* and by sliding the cover 40*a* to the left (as viewed in FIG. 1) until the inner edge 46*a* of the cover 40*a* abuts the inner edge 46*a* of the cover 40*b*. The rifle end 154 can then be placed within the opening 66*b* and the user can utilize the upper plate portions 42*a* and 42*b* as an arm rest, for example for the left arm.

In the preferred embodiment of the invention, the tray 12 and the upper covers 40*a* and 40*b*, are made from polypropylene, which provides for a rugged yet relatively light weight structure. It s also preferred that the upper covers 40*a* and 40*b* are transparent in order to provide for visibility into the tray 12.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A long barreled gun holder, comprising:

a rectangular box including a bottom, two opposed long sides, and two opposed short sides, a pair of gun support forks each including a base portion and a top portion, said top portions having open top slots for receiving a section of a gun barrel, said base portions being insertable into said box, said gun support forks including open slots along their sides for receiving an accessory barrel cleaning rod therein, wall members in said box located at said short sides providing sockets dimensioned to receive said base portions of said forks, the remainder of said box providing storage for gun maintenance accessories.

2. A gun holder as defined in claim 1, including partitions extending between said bottom and said sides dividing said box into a central storage area and opposed side storage areas, and at least one cover member dimensioned to cover a side storage area, and means slidably mounting said cover member to said long sides of said box.

3. A gun holder for a long barreled rifle, comprising:

a rectangular tray including a bottom, two opposed long sides and two opposed short sides, thereby defining an open upper face of the tray;

removable gun support forks attached to the rectangular tray, the gun support forks including open top slots for supporting the rifle;

partitions within said tray between said bottom and sides, dividing said tray into separate storage compartments, at least one of said compartments being adapted to receive said gun support forks; and at least one cover member slidably supported on the tray and at least partially covering said open upper face, the cover member being slidable to access the gun support forks within said tray.

4. A gun holder as defined in claim 3 wherein the gun support forks are retractable from the rectangular tray.

5. A gun holder as defined in claim 4 wherein the gun support forks are profiled to fit within at least one of said compartments for storage thereof.

6. A gun holder as defined in claim 5 wherein the gun support forks include base sections, and the rectangular tray includes support sections defined by the tray adjacent to the short side walls, the base sections of the gun supports being insertable into the support sections for the support thereof.

7. A gun holder as defined by claim 3 wherein the rectangular tray is integrally molded from a suitable plastic material.

8. A gun holder as claimed in claim 3 wherein the gun support forks include along side edges thereof, open slots for the receipt of an accessory barrel cleaning rod.

9. A portable rifle maintenance assembly for a long barreled rifle, comprising:

an accessory box comprising an upper carrying handle mounted thereto for the manual transport thereof; and a gun support assembly receivable over the accessory box, comprising:

a rectangular tray having a bottom section, long side sections and short side sections, thereby defining an open upper face to the tray, the bottom section having a wall extending downwardly from each of the long side sections, thereby defining a receiving nest for the upper section of the accessory box, the rectangular tray including a central opening therethrough for the passage of the carrying handle of the accessory box; and gun support forks attached to the rectangular tray having open top slots for the receipt of a section of a rifle barrel.

10. The portable assembly of claim 9 wherein the gun support assembly includes at least one slidable cover disposed over the open upper face of the tray, the one cover being slidable to expose a storage compartment therein.

11. The portable assembly of claim 10 wherein the gun support forks are removable from the rectangular tray and profiled for receipt within the storage compartment of the rectangular tray.

12. A long barreled gun holder, comprising:

a rectangular box including a bottom, two opposed long sides, and two opposed short sides, a pair of gun support forks each including a base portion and a top portion, said top portions having open top slots for receiving a section of a gun barrel, said base portions being insertable into said box, wall members in said box located at said short sides providing sockets dimensioned to receive said base portions of said forks, and central wall members defining an opening through said bottom, said opening being adapted to pass a handle on an accessory box to permit carrying said rectangular box on the accessory box.

13. The gun support tray of claim 12, further comprising at least one cover member slidably supported on the tray, said at least one cover member exposing said opening therethourgh, when said cover member is in a closed position.

14. The gun support tray of claim 13, wherein two cover members are slidably receivable over said accessory box, said cover members having inner edges positioned proximate to said opening, the expose said opening therethrough.

15. The gun support tray of claim 13, wherein said cover member includes a notched section at an end edge thereof for placement against one of said gun supports.

16. A long barreled gun holder, comprising:

a rectangular box including a bottom, two opposed long sides, and two opposed short sides;

a pair of gun support forks each including a base portion and a top portion, said top portions having open top slots for receiving a section of a gun barrel, said base portions being insertable into said box;

wall members in said box located at said short sides providing sockets dimensioned to receive said base portions of said forks;

at least one end compartment positioned proximate to one of said wall members; and two slidable cover portions adapted to independently slide along a length of said tray, said cover portions having closed positions where said cover portions are proximate to said gun support forks, with one of said cover portions enclosing said one end compartment, said cover portion covering said one end compartment being slidable along said tray to a position exposing said one end compartment without removing either of said gun support forks.

17. The gun holder of claim 16, wherein said cover portions have notched sections at ends thereof profiled for receiving said gun support forks within said notch, when said gun support forks are positioned in said wall members.

18. The gun holder of claim 16, wherein said one end compartment is profiled to receive said gun support forks for storage.

19. The gun holder of claim 18, wherein said tray is profiled for resting on an accessory box having a handle, said tray including an opening therethrough for access to said handle through said opening, whereby said tray and box can be lifted by said handle.

20. The gun holder of claim 19, wherein said cover portions expose said openingg when in said closed position.

* * * * *